US006488191B1

(12) United States Patent
Suggs et al.

(10) Patent No.: US 6,488,191 B1
(45) Date of Patent: Dec. 3, 2002

(54) GOLF BAG SHOULDER STRAP

(75) Inventors: Gregory M. Suggs, Phoenix, AZ (US); John A. Solheim, Phoenix, AZ (US)

(73) Assignee: Karsten Manufacturing Corporation, Phoeniz, AZ (US)

( * ) Notice: Subject to any disclaimer, the term of this patent is extended or adjusted under 35 U.S.C. 154(b) by 0 days.

(21) Appl. No.: 09/960,666

(22) Filed: Sep. 21, 2001

(51) Int. Cl.[7] ..... A45F 3/02

(52) U.S. Cl. ..... 224/643; 206/315.3; 224/264; 224/607

(58) Field of Search ..... 224/643, 150, 224/264, 642, 607; 206/315.3; 150/108, 107

(56) References Cited

U.S. PATENT DOCUMENTS 5,042,703 A 8/1991 Izzo
D365,205 S * 12/1995 Holland, III ..... D3/255
5,544,795 A * 8/1996 Perrin ..... 224/254
5,735,398 A * 4/1998 Price ..... 206/315.3
6,092,574 A * 7/2000 Krulik ..... 150/110
6,223,959 B1 * 5/2001 Chen ..... 224/264
6,330,944 B1 * 12/2001 DeMichele ..... 206/278

* cited by examiner

*Primary Examiner*—Stephen P. Garbe
*Assistant Examiner*—Maerena W. Brevard
(74) *Attorney, Agent, or Firm*—Darrell F. Marquette

(57) ABSTRACT

A golf bag with a generally tubular body has a shoulder strap which allows a golfer to pick up the golf bag from the ground without bending over. The body has an open top end and an annular groove spaced from the open top end. A lower end of the shoulder strap is positioned within the annular groove, and a pair of attachment straps extend from the lower end of the shoulder strap. The attachment straps are disposed within the annular groove when they are wrapped around the body in opposite directions. A buckle connects the attachment straps to each other so that the shoulder strap is held in a standing position where it extends laterally from the body. Stiffener means may be provided at the lower end of the shoulder strap to maintain the shoulder strap in the standing position.

17 Claims, 5 Drawing Sheets

GOLF BAG SHOULDER STRAP

BACKGROUND OF THE INVENTION

This invention relates generally to golf equipment and, in particular, to a shoulder strap for a golf bag.

U.S. Pat. No. 5,042,703 to T. J. Izzo discloses a dual shoulder strap for a golf bag. This dual shoulder strap includes first and second strap members having their outer end portions connected to the golf bag at spaced locations. The strap members have inner end portions formed of flexible webbing material which are sewn together over a relatively broad area to provide them with additional stiffness at a location where the strap members are attached to the golf bag. The additional stiffness of these inner end portions of the strap members causes them to extend away from the golf bag in a raised position when the golf bag is placed on the ground. This allows a golfer to more easily grasp the shoulder strap and pick up the golf bag.

SUMMARY OF THE INVENTION

The present invention provides a shoulder strap for use in combination with a golf bag which has a generally tubular body with a longitudinal axis and an open top end. The shoulder strap includes a strap member having an upper end coupled to the body proximate the open top end thereof. A pair of attachment straps extend from a lower end of the strap member for attaching the lower end of the strap member to the body at a location spaced from the open top end thereof and for holding the shoulder strap in a standing position where it extends laterally from the body. Stiffener means are provided at the lower end of the strap member for maintaining the shoulder strap in the standing position.

An annular groove may be formed in the body at the attachment location, and the attachment straps are wrapped around the body in opposite directions and disposed within the annular groove. Buckle means connect the attachment straps to each other to attach the shoulder strap to the body with the lower end of the strap member extending from the annular groove in a generally perpendicular attitude relative to the longitudinal axis of the body.

Securing means may also be provided on the lower end of the strap member and in the annular groove of the body for preventing rotational movement of the strap member lower end relative to the body. The strap member has a blunt edge formed on its lower end which is pulled into a bifurcated shape that straddles a ridge on the body when the attachment straps are wrapped around the body. Fastener means may be mounted on the blunt edge of the strap member lower end and in the annular groove atop the body ridge so that, when the fastener means is fastened, the lower end of the strap member is held against rotational movement about the body.

One embodiment of the stiffener means comprises a foam pad encased within a fabric cover. The foam pad is folded back upon itself at the lower end of the strap member to provide a double thickness of foam which maintains the shoulder strap in the standing position. Another embodiment of the stiffener means comprises a rod having a pair of legs shaped to provide the rod with an elongated upper end that is disposed in the lower end of the strap member. The pair of legs are configured to provide the rod with a bifurcated lower end which extends from the lower end of the strap member. The bifurcated lower end of the rod lies within the annular groove and straddles the body.

DESCRIPTION OF THE PREFERRED EMBODIMENTS.

Figure 1:
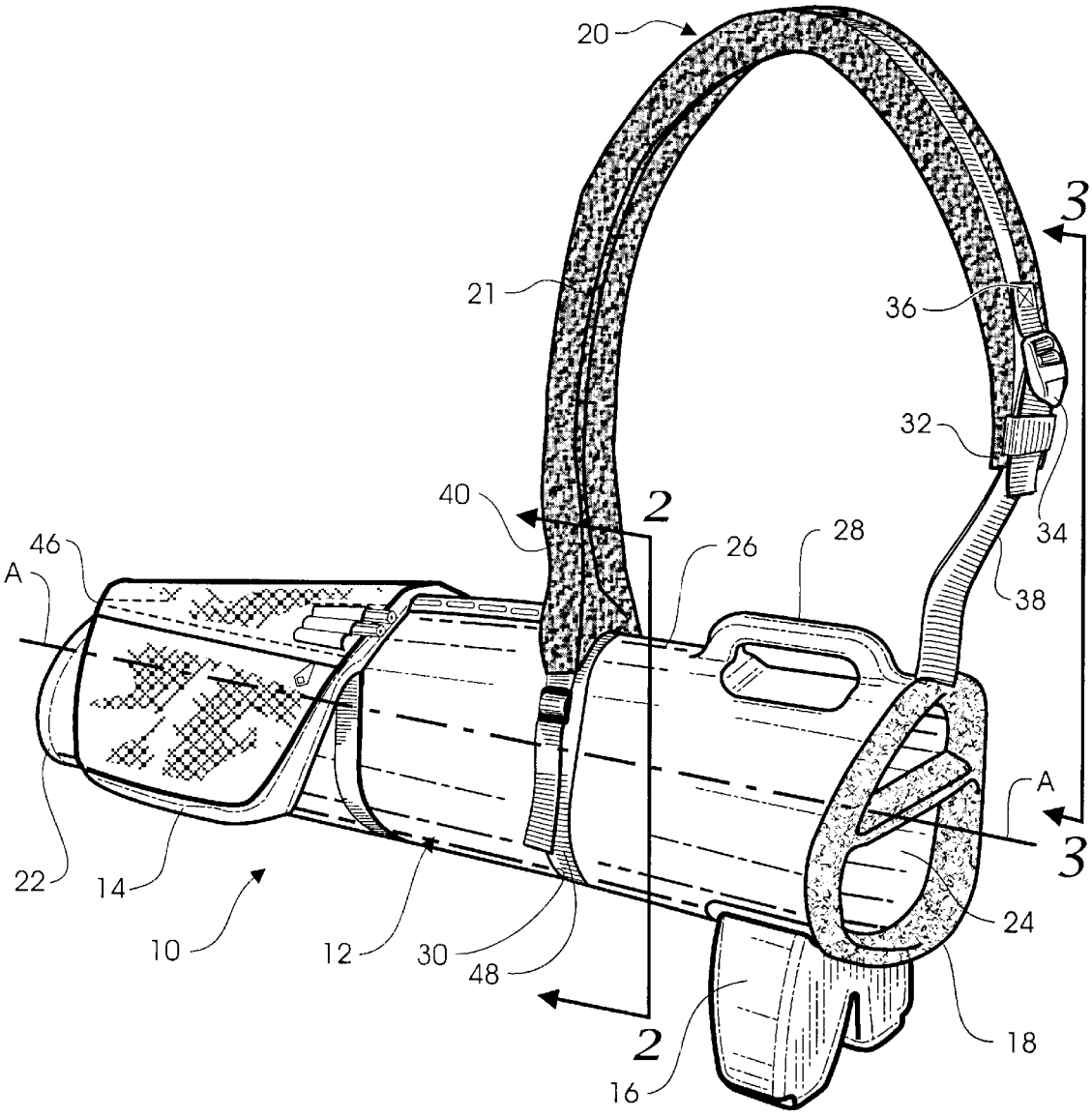
FIG. 1 is a perspective view of the golf bag including a generally tubular body and incorporating a shoulder strap including a strap member attached to the tubular body.

Referring to the drawings, FIG. 1 shows a golf bag which is indicated generally by the reference numeral 10. The golf bag 10 includes a generally tubular body 12, a pocket assembly 14 for carrying accessories used in playing golf such as golf balls, tees and the like. Also included on the golf bag 10 is a stand 16 for propping up the body 12 so that, whenever the golf bag 10 is resting on the ground, the heads of the golf clubs (not shown) carried in the golf bag 10 will not contact the ground. The body 12 has a protective collar 18 attached thereto with the collar 18 having an upper end 32 of a strap member 21 of a shoulder strap 20 coupled thereto. A lower end 40 of the strap member 21 is coupled to the body 12 by a pair of attachment straps 48, 50.

The body 12 is an elongated unitary structure having a closed bottom end 22 and an open top end 24. The body 12 preferably has a generally ovoid cross sectional shape so that a relatively small radius portion SR (FIG. 2) of the ovoid shape provides a ridge 26 which extends generally longitudinally of the body 12. A handle 28 is integrally formed on and along one side of the body 12 so as to extend therefrom in a plane that is substantially perpendicular to the longitudinal axis A of the body 12. The handle 28 is positioned on the ridge 26 proximate the open top end 24 of the body 12. An annular groove 30 is formed in the body 12 for receiving the attachment straps 48, 50 extending from the lower end 40 of the strap member 20 to prevent longitudinal movement of the strap member lower end 40 when the shoulder strap 20 is attached to the body 12 in the manner shown in FIG. 1.

Figure 3:
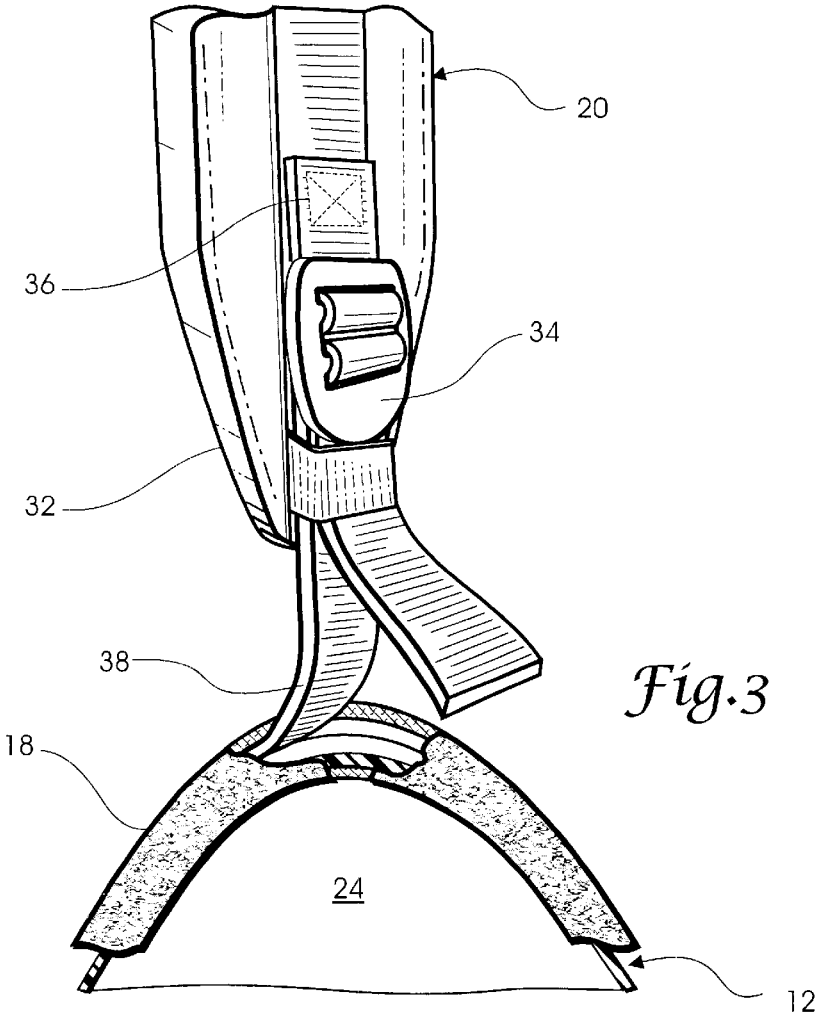
FIG. 3 is an enlarged sectional view taken along lines 3—3 in FIG. 1.

The upper end 32 of the strap member 21 is coupled to the body 12 proximate the open top end 24 thereof and, as best seen in FIG. 3, the strap member upper end 32 has a buckle 34 mounted thereon by a loop 36 of webbing material that is attached thereto by sewing. A strap 38 is fixed to the protective collar 18 and extends therefrom for connection to the buckle 34.

Figure 2:
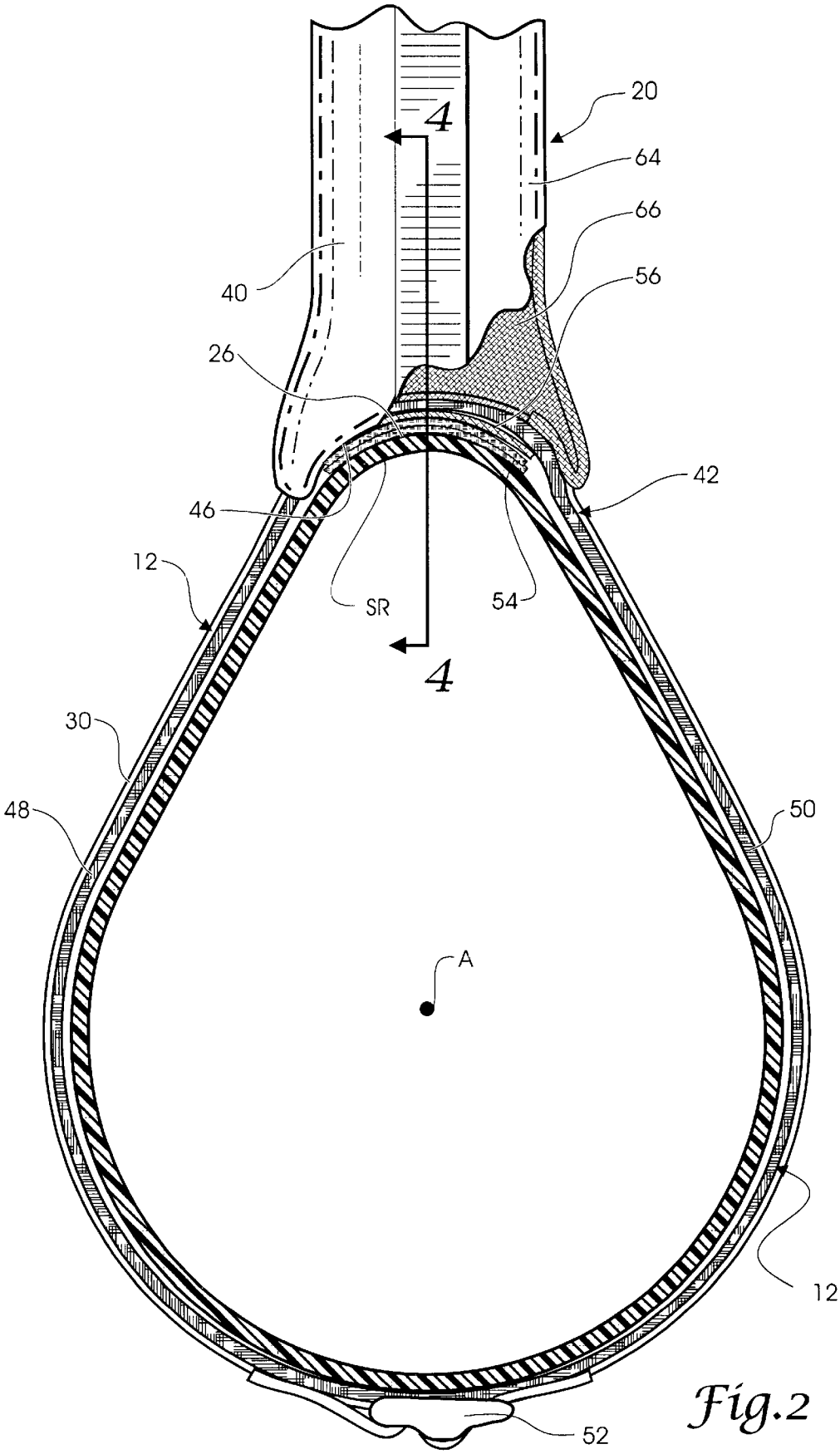
FIG. 2 is an enlarged sectional view taken along the lines 2—2 in FIG. 1 showing one embodiment of securing means for preventing rotational movement of the strap member relative to the body.

FIG. 2 shows the attachment straps 48, 50 for attaching the lower end 40 of the strap member 21 to the body 12 and thereby holding the shoulder strap 20 in a standing position where it extends laterally (upwardly in FIG. 1) from the body 12. The lower end 40 of the strap member 21 is also provided with stiffener means 44 for maintaining the shoulder strap 20 in the standing position. A blunt edge 46 of the strap member lower end 40 is disposed transverse to the length dimension of the strap member 21. The pair of attachment straps 48, 50 extend from the blunt edge 46 of the strap member lower end 40, and a buckle 52 is provided on the attachment strap 48. The attachment straps 48, 50 are wrapped around the body 12 and are disposed within the annular groove 30. The strap 50 is engaged with the buckle 52 to connect the attachment straps 48, 50 to each other and to attach the lower end 40 of the strap member 21 to the body 12. As seen in FIG. 2, the blunt edge 46 of the strap member lower end 40 is positioned atop the ridge 26, and the attachment straps 48, 50 are secured to each other tightly enough to pull the blunt edge 46 downwardly into the annular groove 30 so that the blunt edge 46 is pulled into a bifurcated shape that straddles the ridge 26. Such mounting of the lower end 40 of the strap member 21 will position the lower end 40 of the strap member 21 so that it extends from the body 12 in a generally perpendicular attitude relative to the longitudinal axis A of the body 12. With the upper and lower ends 32 and 40, respectively, of the strap member 21 attached to the body 12 as described above, the shoulder strap 20 will form a loop that extends from the body 12 in a plane that is substantially perpendicular to the longitudinal axis A of the body 12, with that plane being the same plane in which the handle 28 lies.

With the attachment straps 48, 50 secured to each other and disposed within the annular groove 30, the lower end 40 of the strap member 21 is held against longitudinal movement along the longitudinal axis A of the body 12. However, unwanted rotational movement of the lower end 40 of the strap member 21 and the attachment straps 48, 50 about the body 12 might occur when the golf bag 10 is lifted and carried on the shoulder of a golfer. To prevent such unwanted rotational movement, securing means is provided which in one embodiment includes a strip 54 of a fastener, such as a hook and loop fastener, fixed within the annular groove 30 atop the ridge 26 by using a suitable adhesive. Another strip 56 of the hook and loop fastener is attached by sewing to the blunt edge 46 of the strap member lower end 40. The strips 54, 56 of the hook and loop fastener will engage each other and thus prevent rotational movement of the lower end 40 of the strap member 21 relative to the body 12.

Figure 5:
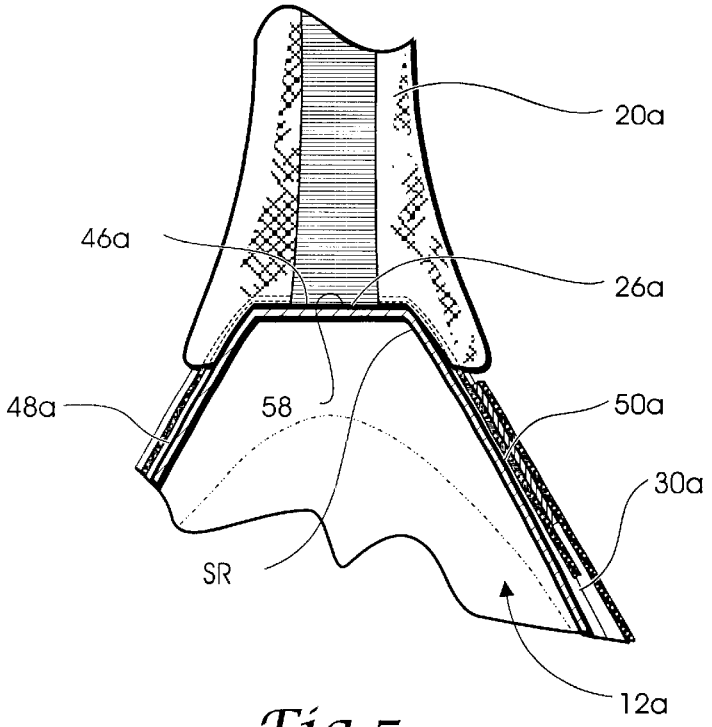
FIG. 5 is a sectional view similar to FIG. 2 showing another embodiment of securing means for preventing rotational movement of the strap member relative to the body.
Figure 6:
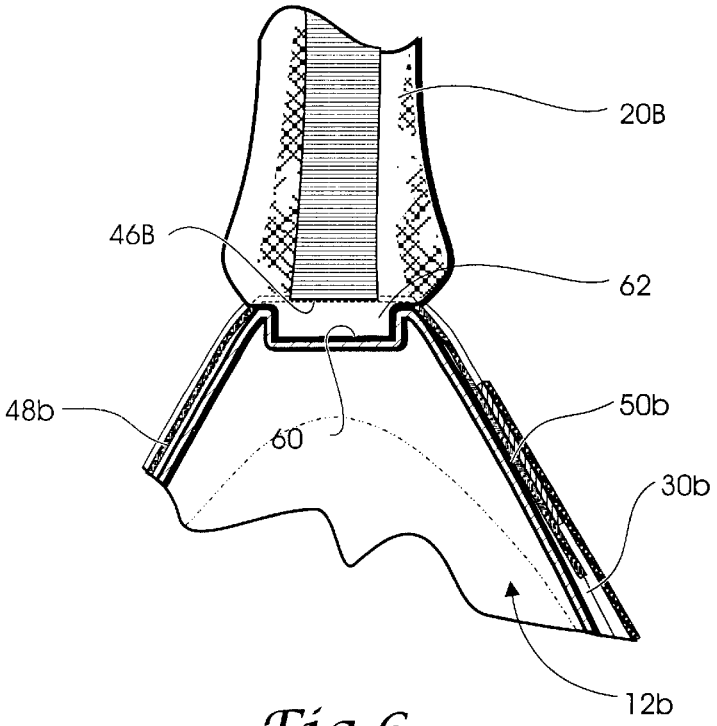
FIG. 6 is a sectional view similar to FIG. 2 showing a further embodiment of securing means for preventing rotational movement of the strap member relative to the body.

Another embodiment of securing means is shown in FIG. 5 wherein a modified body 12*a* is provided with a ridge 26*a* having a flat surface 58 at the apex of the small radius portion SR of the ovoid shape of the body 12*a*. The flat surface 58 may extend the full length of the ridge 26*a* or it may be formed only within an annular groove 30*a* where a blunt edge 46*a* of the shoulder strap 20*a* is mounted and held therein by the attachment straps 48*a*, 50*a*. FIG. 6 shows a further embodiment of securing means which includes a modified body 12*b* and a modified shoulder strap 20*b*. In this embodiment, the body 12*b* may be of any desired cross-sectional configuration, such as round, and is provided with a mortice 60 within the annular groove 30*b* in the body 12*b* at the point where the attachment straps 48*b*, 50*b* attach the shoulder strap 20*b* to the body 12. The blunt edge 46*b* of the shoulder strap 20*b* is formed with a tenon 62 which mates with the mortice 60 to form a mortice-tenon joint which holds the shoulder strap 20*b* in the standing position.

Figure 4:
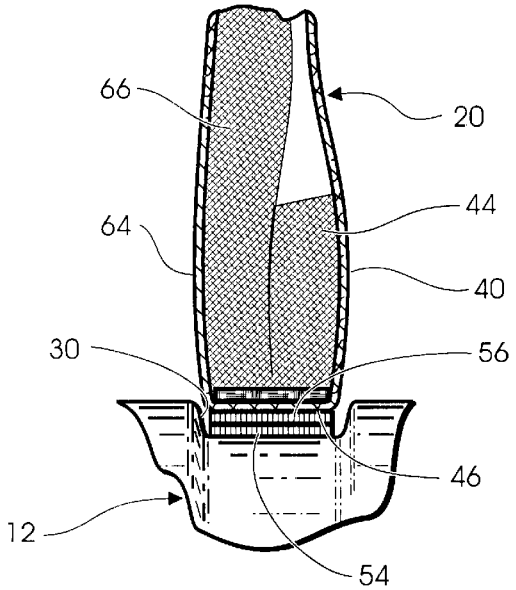
FIG. 4 is a sectional view taken along the lines 4—4 in FIG. 2 showing the securing means of FIG. 2 and one embodiment of stiffener means for maintaining the shoulder strap in a standing position.

The strap member 21 is formed by sewing a fabric cover 64 over a foam pad 66 so that the foam pad 66 is encased within the fabric cover 64. Since the foam pad 66 may not provide the strap member 21 with enough inherent stiffness to hold the shoulder strap 20 in the standing position, stiffener means 44 (as seen in FIG. 4) is provided in the lower end 40 of the strap member 21. The stiffener means 44 is formed by folding the foam pad 66 back upon itself to provide a double thickness of foam at the lower end 40 of the strap member 21.

Figure 7:
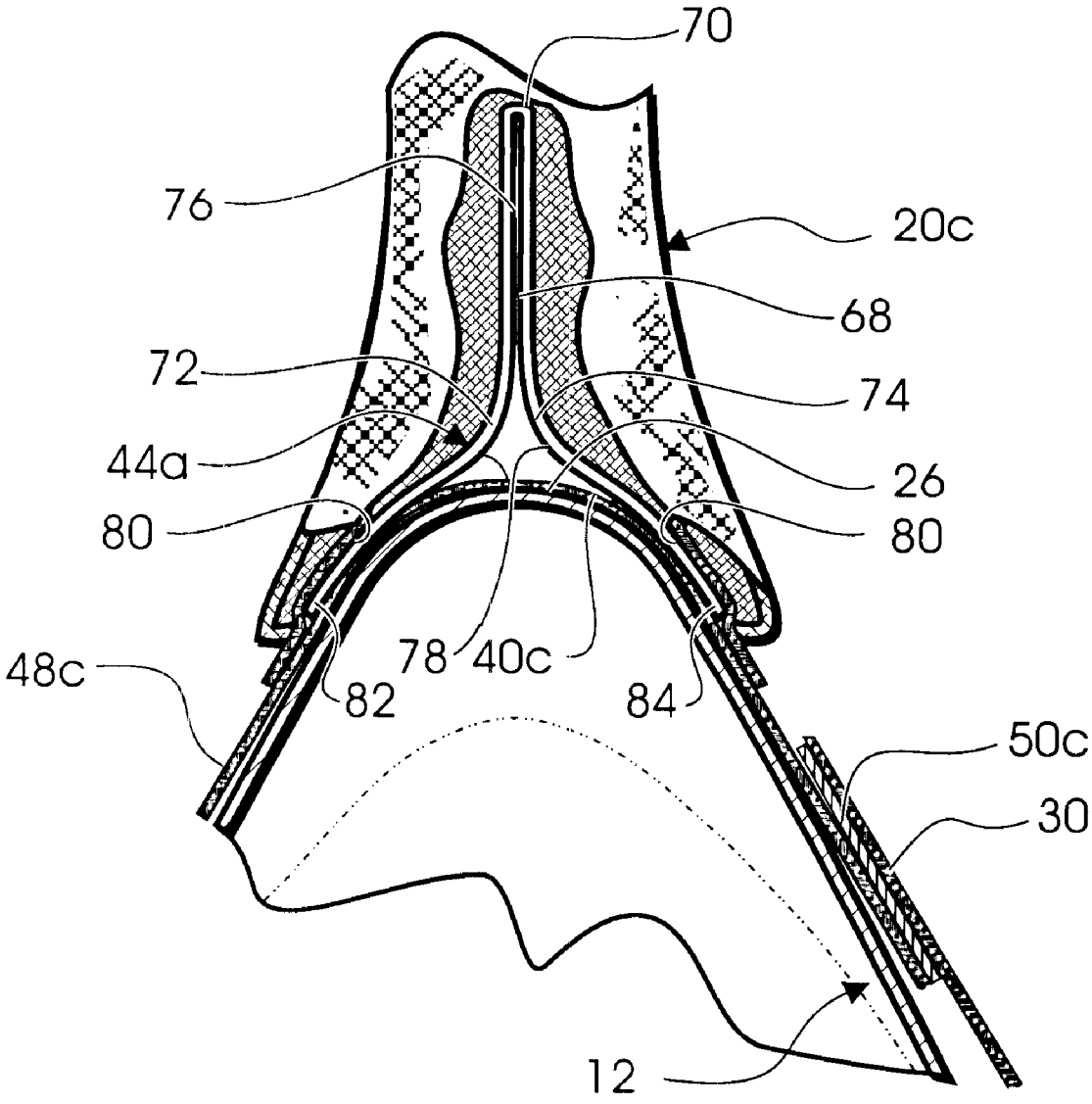
FIG. 7 is a sectional view similar to FIG. 2 showing another embodiment of stiffener means for maintaining the shoulder strap in a standing position.

If the foam pad 66 has a relatively high density, the stiffener means 44 will provide the strap member 21 with sufficient stiffness to maintain the shoulder strap 20 in the standing position. However, since a high density foam pad may be uncomfortable when the golf bag 10 is being supported on the shoulder of a golfer, stiffener means 44*a* shown in FIG. 7 is preferred.

The stiffener means 44*a* includes a rod 68 which is folded over at 70 to provide a pair of legs 72 and 74 which form an elongated upper end 76 that is disposed within the strap member 21*c*. The legs 72, 74 are bent approximately midway along their length to provide the rod 68 with a bifurcated lower end 78 that extends from the lower end 40*c* of the strap member 21*c*. The shoulder strap 20*c* is provided with attachment straps 48*c* and 50*c* for attaching the lower end 40*c* of the strap member 21*c* to the body 12 in the manner described above. The attachment straps 48*c*, 50*c* are each provided with a pocket 80 into which the respective outer ends 82 and 84 of the legs 72 and 74 are contained. The elongated upper end 76 of the rod 68 and the bifurcated lower end 78 thereof will hold the shoulder strap 20*c* in the standing position and will also prevent unwanted rotational movement of the lower end 40*c* thereof about the body 12*c*.

What is claimed is:

1. In combination with a golf bag having a generally tubular body with a longitudinal axis and an open top end, a shoulder strap comprising:

a strap member having an upper end coupled to said body proximate the open top end thereof;

a pair of attachment straps extending from a lower end of said strap member for attaching the lower end of said strap member to said body at a location spaced from the open top end thereof and for holding said shoulder strap in a standing position where said shoulder strap extends laterally from said body;

stiffener means at the lower end of said strap member for maintaining said shoulder strap in the standing position;

an annular groove formed in said body at said attachment location;

said attachment straps being wrapped around said body in opposite directions and disposed within said annular groove; and buckle means for connecting said atachmrent straps to each other to attach said shoulder strap to said body with the lower end of said strap member extending from said annular groove in a generally perpendicular attitude relative to the longitudinal axis of said body.

2. In the combination of claim 1, further comprising securing means on the lower end of said strap member and in said annular groove for preventing rotational movement of the lower end of said strap member relative to said body.

3. In the combination of claim 2, wherein said securing means comprises said strap member having a blunt edge formed on its lower end which is pulled into a bifurcated shape that straddles a ridge on said body when said attachment straps are wrapped around said body.

4. In the combination of claim 3, wherein said securing means further comprises fastener means mounted on the blunt edge of said strap member lower end and in said annular groove atop said ridge so that, when said fastener means is fastened, the lower end of said strap member is held against rotational movement about said body.

5. In the combination of claim 4, wherein said fastener means comprises a hook and loop fastener.

6. In the combination of claim 2, wherein said securing means comprises said strap member having a blunt edge formed on its lower end which is pulled into contiguous engagement with a flat surface on a ridge on said body when said attachment straps are wrapped around said body.

7. In the combination of claim 2, wherein said securing means comprises said strap member having a blunt edge formed on its lower end, said blunt lower edge having a tenon extending from the blunt edge thereof into a mortice formed in said annular groove in said body.

8. In combination with a golf bag having a generally tubular body with a longitudinal axis and an open top end, a shoulder strap comprising:

a strap member having an upper end coupled to said body proximate the open top end thereof;

a pair of attachment straps extending from a lower end of said strap member for attaching the tower end of said strap member to said body at a location spaced from the open top end thereof and for holding said shoulder strap in a standing position where said shoulder strap extends laterally from said body;

stiffener means at the lower end of said strap member for maintaining said shoulder strap in the standing position; and said stiffener means including a foam pad encased within a fabric cover, said foam pad being folded back upon itself at the lower end of said strap member to provide a double thickness of foam which maintains the shoulder strap in the standing position.

9. In combination with a golf bag having a generally tubular body with a longitudinal axis and an open top end, a shoulder strap comprising:

a strap member having an upper end coupled to said body proximate the open top end thereof;

a pair of attachment straps extending from a lower end of said strap member for attaching the lower end of said strap member to said body at a location spaced from the open top end thereof and for holding said shoulder strap in a standing position where said shoulder strap extends laterally from said body;

stiffener means at the lower end of said strap member for maintaining said shoulder strap in the standing position; and said stiffener means including a rod having a pair of legs which are shaped to provide said rod with an elongated upper end tat is disposed in the lower end of said strap member, and wherein said pair of legs are configured to provide said rod with a bifurcated lower end which extends from the lower end of said shoulder strap, said bifurcated lower end of said rod straddling said body and lying within an annular groove formed in said body.

10. In combination with a golf bag having a generally tubular body with a longitudinal axis and an open top end, a shoulder strap comprising:

a strap member having an upper end coupled to said body proximate the open top end thereof;

a pair of attachment straps extending from a lower end of said strap member for attaching the lower end of said strap member to said body at a location spaced from the open top end thereof and for holding said shoulder strap in a standing position where said shoulder strap extends laterally from said body;

stiffener means at the lower end of said strap member for maintaining said shoulder strap in the standing position;

said stiffener means including a rod having a pair of legs which are shaped to provide said rod with an elongated upper end that is disposed in the lower end of said strap member, said pair of legs being configured to provide said rod with a bifurcated lower end which extends from the lower end of said strap member, said bifurcated lower end of said rod straddling said body and lying within an annular groove formed in said body, each of said legs of said rod having an outer end; and each of said attachment straps having a pocket for containing the outer end of one of said legs of said rod.

11. In combination with a golf bag having a generally tubular body with a longitudinal axis and an open top end, said body having an annular groove formed therein in spaced relationship with the open top end, a shoulder strap comprising:

a strap member having an upper end coupled to said body proximate the open top end thereof;

a pair of attachment straps extending from a lower end of said strap member, said attachment straps being wrapped around said body in opposite directions and disposed within said annular groove; and buckle means for connecting said attachment straps to each other to attach said shoulder strap to said body with the lower end of said strap member extending from said annular groove in a generally perpendicular attitude relative to the longitudinal axis of said body.

12. In the combination of claim 11, further comprising securing means on the lower end of said strap member and in said annular groove for preventing rotational movement of the lower end of said strap member relative to said body.

13. In the combination of claim 12, wherein said securing means comprises said strap member having a blunt edge formed on its lower end which is pulled into a bifurcated shape that straddles a ridge on said body when said attachment straps are wrapped around said body.

14. In the combination of claim 13, wherein said securing means further comprises fastener means mounted on the blunt edge of said strap member lower end and in said annular groove atop said ridge so that, when said fastener means is fastened, the lower end of said strap member is held against rotational movement about said body.

15. In the combination of claim 14, wherein said fastener means comprises a hook and loop fastener.

16. In the combination of claim 12, wherein said securing means comprises said strap member having a blunt edge formed on its lower end which is pulled into contiguous engagement with a flat surface on a ridge on said body when said attachment straps are wrapped around said body.

17. In the combination of claim 12, wherein said securing means comprises:

said body having a mortice formed in said annular groove; and said strap member having a blunt edge formed on its lower end, said blunt edge having a tenon extending therefrom into the mortice.

* * * * *